US008659508B2

(12) United States Patent
Todoroki

(10) Patent No.: US 8,659,508 B2
(45) Date of Patent: Feb. 25, 2014

(54) PROJECTOR AND IMAGE PROCESSING APPARATUS

(75) Inventor: Akinari Todoroki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 989 days.

(21) Appl. No.: 12/115,104

(22) Filed: May 5, 2008

(65) Prior Publication Data

US 2008/0316146 A1 Dec. 25, 2008

(30) Foreign Application Priority Data

Jun. 25, 2007 (JP) ..... 2007-166161

(51) Int. Cl.
*G09G 5/00* (2006.01)
*G09G 5/02* (2006.01)

(52) U.S. Cl.
USPC ..... 345/7; 345/698

(58) Field of Classification Search
USPC ..... 345/7, 698, 699, 966, 204
See application file for complete search history.

(56) References Cited

U.S. PATENT DOCUMENTS

| | | | | |
|---|---|---|---|---|
| 5,426,737 | A * | 6/1995 | Jacobs | 710/27 |
| 5,887,125 | A * | 3/1999 | Takano et al. | 358/1.12 |
| 6,005,849 | A * | 12/1999 | Roach et al. | 370/276 |
| 6,084,686 | A | 7/2000 | Ushida | |
| 7,684,437 | B2 * | 3/2010 | Miller et al. | 370/466 |
| 7,701,452 | B2 * | 4/2010 | Fujiwara | 345/204 |
| 2001/0013863 | A1 * | 8/2001 | Chen et al. | 345/204 |
| 2003/0068094 | A1 * | 4/2003 | Kimura et al. | 382/274 |
| 2004/0042547 | A1 * | 3/2004 | Coleman | 375/240.01 |
| 2004/0201594 | A1 * | 10/2004 | Nashida et al. | 345/647 |

FOREIGN PATENT DOCUMENTS

| | | |
|---|---|---|
| JP | A-10-157218 | 6/1998 |
| JP | A-2000-311241 | 11/2000 |
| JP | 2001-177787 | 6/2001 |
| JP | A-2002-007115 | 1/2002 |
| JP | A-2002-232729 | 8/2002 |
| JP | 2003-084738 | 3/2003 |

(Continued)

*Primary Examiner* — William Boddie
*Assistant Examiner* — Towfiq Elahi
(74) *Attorney, Agent, or Firm* — Oliff PLC

(57) ABSTRACT

A projector which displays an image by projecting a projection image onto a projection surface, includes: a fixed pixel display device for displaying the projection image in a predetermined vertical period; and an image processing device for generating the projection image in the vertical period, wherein the image processing device includes: a resolution converter which, by converting a resolution of an input image in the vertical period, generates and transmits a display image having a desired resolution; a projection distortion corrector which receives the display image, and generates the projection image by correcting the display image in the vertical period in such a way as to correct a projection distortion occurring due to a projection angle with respect to the projection surface when projecting the projection image; and a display image input/output controller which controls the reception of the display image from the resolution converter and the transmission thereof to the projection distortion corrector, wherein in the vertical period, the display image input/output controller holds the display image while receiving it from the resolution converter, during a time period from a predetermined timing prior to a start time of a process of correcting the display image by means of the projection distortion corrector to a finish time of the correction process, while it reads the display image held in advance, and transmits it to the projection distortion corrector, during a time period from the start time to the finish time of the correction process.

14 Claims, 7 Drawing Sheets

(56) References Cited

FOREIGN PATENT DOCUMENTS

| | | |
|---|---|---|
| JP | A-2005-39593 | 2/2005 |
| JP | 2005-210418 | 8/2005 |
| JP | A-2006-246102 | 9/2006 |
| JP | A-2006-308665 | 11/2006 |
| JP | A-2006-349792 | 12/2006 |

* cited by examiner

PROJECTOR AND IMAGE PROCESSING APPARATUS

This application claims priority from Japanese Patent Application No. 2007-166161 filed in the Japanese Patent Office on Jun. 25, 2007, the entire disclosure of which is hereby incorporated by reference in its entirety.

BACKGROUND

1. Technical Field

The present invention relates to a projector using a fixed pixel display device, and an image processing device included in the projector.

2. Related Art

A projector, which uses a fixed pixel display device such as a liquid crystal panel or a DMD (Digital Micromirror Device, a trademark of Texas Instruments, Inc.) to project an image formed on the fixed pixel display device onto a screen, has been put into practical use.

FIG. 7 is an illustration showing an outline of a process executed in a case in which an image is projected by a heretofore known projector.

In the heretofore known projector, an execution of an image process which converts a resolution of an input image (hereafter referred to as a "resolution conversion process" or simply as a "resolution conversion") is carried out in order to match the resolution of the input image with a resolution of a fixed pixel display device, as well as adjust a size of a projection image projected onto a screen (hereafter referred to also as a "projection size"). Also, in the same way, in the heretofore known projector, an execution of an image process which transforms a shape of an image formed on the fixed pixel display device (hereafter referred to also as a "keystone process") is carried out in order to correct a distortion occurring in the projection image (hereafter referred to as a "projection distortion" or a "keystone distortion") in accordance with a projection angle with respect to the screen. In this specification, the "resolution" means a number of dots (a number of pixels) in a horizontal direction, and a number of lines (a number of scanning lines) in a vertical direction, of the image or the fixed pixel display device. Then, there is also a case of referring to the number of dots in the horizontal direction as a "horizontal resolution", and the number of lines in the vertical direction as a "vertical resolution".

Specifically, as shown in FIG. 7, the resolution conversion process is executed in a resolution converter, and the keystone process is executed in a keystone processor. The resolution converter, with the resolution of the fixed pixel display device (in this example, "1024'768 dots") as a reference (hereafter referred to also as a "reference projection size"), executes the process of converting a resolution of an image (the input image) represented by image data included in an input image signal (hereafter referred to also as "input image data), in accordance with a desired projection size (in this example, "about 79%") preset at the reference projection size or smaller, and generates image data (hereafter referred to also as a "display image data") representing an image to be displayed (hereafter referred to also as a "display image") which has a resolution (a resolution "800'600 dots" corresponding to the projection size "about 79%") lower than or equal to the resolution of the fixed pixel display device. Then, the keystone processor executes a correction process (the keystone process) according to the projection angle with respect to the screen on the display image data, and generates image data having the projection distortion corrected (hereafter referred to also as "keystone correction image data"). By forming an image represented by the generated keystone correction image data (hereafter referred to also as a "keystone correction image") on the fixed pixel display device as a projection image, the projection image having the projection size adjusted and the projection distortion corrected is displayed on the screen.

Herein, the resolution conversion process in the resolution converter and the keystone process in the keystone processor are each executed within a time period, from a start time to a finish time of the image formation on the fixed pixel display device, within each frame period represented by a predetermined vertical period (generally referred to as a "frame period") which serves as a reference for forming the image on the fixed pixel display device. At this time, the higher a resolution conversion ratio (an upscaling ratio or a downscaling ratio), the higher a processing speed in the resolution converter is required to be. Also, in the same way, the greater the projection angle, the higher a processing speed in the keystone processor is required to be. In addition, as the keystone processor executes the keystone process, using the image data transmitted from the resolution converter, it having to wait until resolution converted image data necessary for the process are transmitted from the resolution converter as the display image data, a still higher speed is required of it depending on a length of the wait time.

Herein, for example, in a case of a kind of projection angle in which a resolution conversion ratio in the resolution converter is halved in a vertical direction, and an image transformation ratio in the keystone processor is halved in a vertical direction, the resolution converter carries out a process of converting horizontal 4-line input image data into 2-line resolution converted data, and transmits them. Also, the keystone processor carries out a process of transforming the horizontal 2-line resolution converted data from the resolution converter into 1-line keystone correction image data, and transmits them. Consequently, it follows that the keystone processor carries out the process of transforming the horizontal 4-line input image data directed to the resolution converter into the 1-line keystone correction image data, and transmits them, and that it is required to have a processing speed four times higher than in a case of carrying out neither the resolution conversion nor the keystone process. For this reason, in the event that a possible processing speed in the keystone processor is lower than the fourfold processing speed, a projection is impossible at an angle corresponding to this. Consequently, the heretofore known projector responds by setting a restriction on a projection angle range, based on the possible processing speed in the resolution converter or the keystone processor. For this reason, it is desired to ease the restriction on the projection angle range and expand the projection angle range.

As a simple method of expanding the projection angle range, it is conceivable to dispose a frame memory between the resolution converter and the keystone processor. However, this method is undesirable as it requires a memory for at least one frame, causing an increase in a manufacturing cost.

Examples of the related art include JP-A-2003-84738, JP-A-2005-210418 or JP-A-2001-177787.

SUMMARY

An advantage of some aspects of the invention is to provide a technology capable of easily expanding a projection angle range.

The invention can be realized as the following aspects or application examples.

Application Example 1

A projector which displays an image by projecting a projection image onto a projection surface, includes: a fixed pixel display device for displaying the projection image in a predetermined vertical period; and an image processing device for generating the projection image in the vertical period. The image processing device includes: a resolution converter which, by converting a resolution of an input image in the vertical period, generates and transmits a display image having a desired resolution; a projection distortion corrector which receives the display image, and generates the projection image by correcting the display image in the vertical period in such a way as to correct a projection distortion occurring due to a projection angle with respect to the projection surface when projecting the projection image; and a display image input/output controller which controls the reception of the display image from the resolution converter and the transmission thereof to the projection distortion corrector. In the vertical period, the display image input/output controller holds the display image while receiving it from the resolution converter, during a time period from a predetermined timing prior to a start time of a process of correcting the display image by means of the projection distortion corrector to a finish time of the correction process, while it reads the display image held in advance, and transmits it to the projection distortion corrector, during a time period from the start time to the finish time of the correction process.

According to Application Example 1, as the display image input/output controller receives the display image from the resolution converter, and holds it ahead of the correction process, during the time period from the predetermined timing prior to the start time of the process of correcting the display image by means of the projection distortion corrector to the start time of the correction process, it can read and transmit the display image held in advance, during the time period from the start time to the finish time of the correction process. Therefore, it being possible to reduce the wait time which causes a problem in the heretofore known technology, it is possible to easily expand the projection angle range.

Application Example 2

In the projector of Application Example 1, the display image input/output controller includes: an image memory having a plurality of line memories capable of accumulating images equivalent to one horizontal line of the display image. The display image input/output controller, in the event that there is an updatable line memory among the plurality of line memories, by giving the resolution converter a first instruction to transmit the display image, receives the display image transmitted from the resolution converter, and accumulates it in the image memory and, in the event that there is no updatable line memory among the plurality of line memories, by not giving the first instruction, as well as stopping the transmission of the display image from the resolution converter and stopping the accumulation of the display image in the image memory, by receiving a second instruction to transmit the display image accumulated in the image memory by the projection distortion corrector, reads and transmits the display image accumulated in the image memory.

According to Application Example 2, it is possible to easily realize a configuration in which the display image input/output controller holds the display image while receiving it from the resolution converter, during the time period from the predetermined timing prior to the start time of the process of correcting the display image by means of the projection distortion corrector to the finish time of the correction process, while it reads the display image held in advance, and transmits it to the projection distortion corrector, during the time period from the start time to the finish time of the correction process.

Application Example 3

In the projector of Application Example 2, a number of the plurality of line memories included in the image memory is determined to be smaller than that of the fixed pixel display device in accordance with a difference between a processing speed of the resolution conversion in the resolution converter and a processing speed of the projection distortion correction in the projection distortion corrector.

According to Application Example 3, there is an advantage in reducing a size and cost of the apparatus.

The invention, not being limited to the projector, can be realized in various modes, such as an image processing apparatus and an image processing method.

BRIEF DESCRIPTION OF THE DRAWINGS

The invention will be described with reference to the accompanying drawings, wherein like numbers reference like elements.

DETAILED DESCRIPTION OF EMBODIMENTS

Hereafter, a description will be given of a best mode for carrying out the invention, based on an embodiment, in the following order: A. Configuration of Liquid Crystal Projector, B. Configuration and Control Operation of Display Data Controller, and C. Modification Examples.

A. CONFIGURATION OF LIQUID CRYSTAL PROJECTOR

Figure 1:
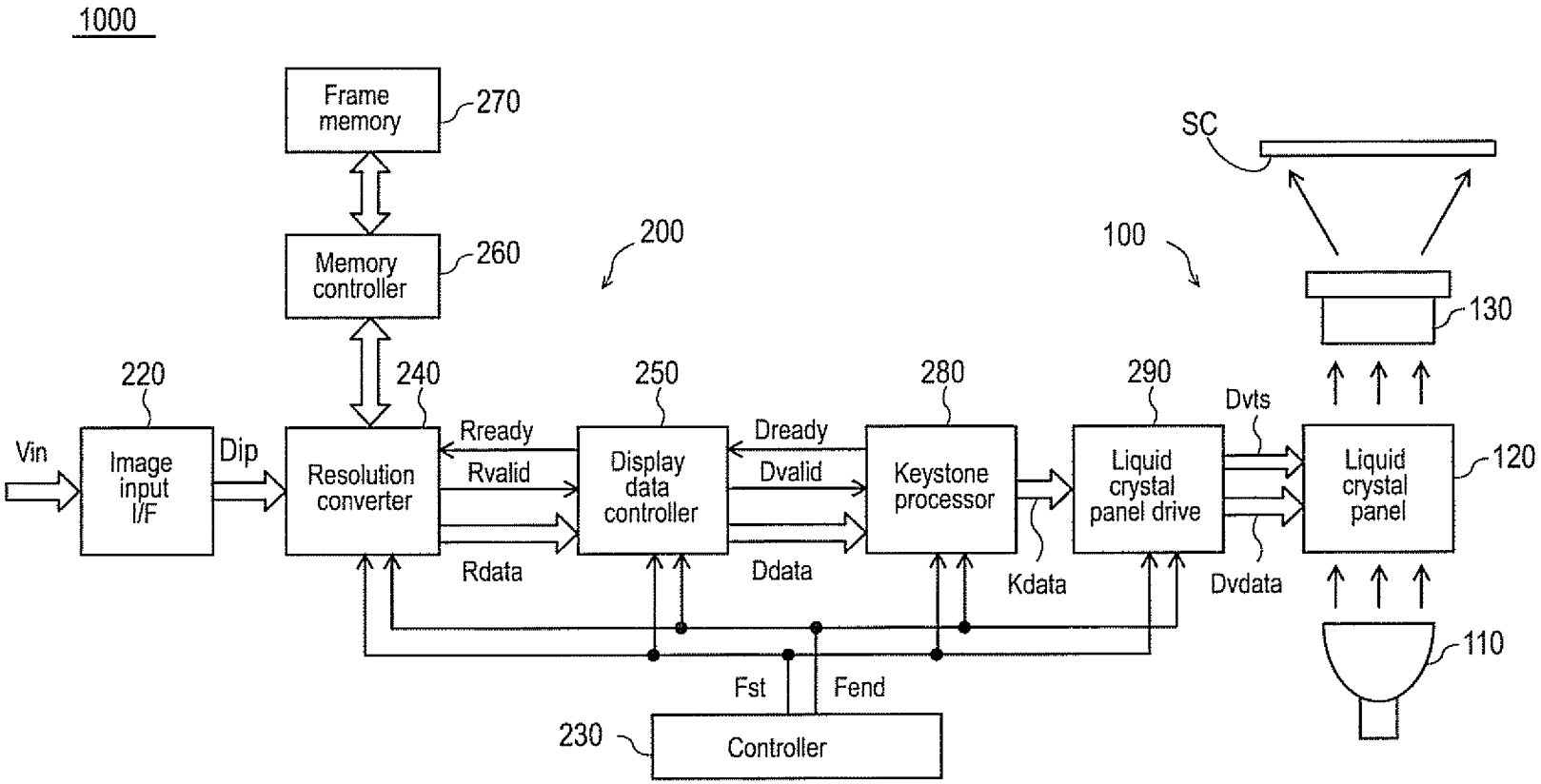
FIG. 1 is a block diagram showing an outline configuration of a liquid crystal projector 1000 which is an embodiment of the invention.

FIG. 1 is a block diagram showing an outline configuration of a liquid crystal projector 1000 which is an embodiment of the invention. The liquid crystal projector, being a projection type display apparatus which projects an input image, represented by input image data included in an input image signal Vin, onto a screen SC, includes an optical processor 100 and an image processor 200. The image processor 200 corresponds to an image processing apparatus of some aspects of the invention.

The optical processor 100 includes a light source 110, a liquid crystal panel 120 acting as a fixed pixel display device, and a projection lens 130. Light emitted from the light source 110, in the liquid crystal panel 120, is modulated in accordance with an image (a projection image) formed according to a drive image data signal Dvdata and a drive timing signal Dvts which are given from the image processor 200 and, after being converted into light representing the projection image (referred to also as "image light"), is caused to form an image on the screen SC by the projection lens 130. By this means, the image (projection image) is displayed projected onto the screen SC.

Although not shown, the liquid crystal projector 1000 including three liquid crystal panels 120 for converting R (red), G (green) and B (blue) color lights into image lights of the individual colors, after the light emitted from the light source 110 is separated into the R, G and B color lights by a color light separation optical system (not shown), the color lights are converted into the image lights of the individual colors in the corresponding liquid crystal panels, synthesized by a synthesis optical system (not shown), and fall incident on the projection lens 130.

The image processor 200 includes an image input interface (I/F) 220, a timing controller 230, a resolution converter 240, a memory controller 260, a frame memory 270, a display data controller 250, a keystone processor 280 and a liquid crystal panel drive 290. The keystone processor 280 corresponds to a projection distortion corrector of some aspects of the invention, and the display data controller 250 corresponds to a display image input/output controller of some aspects of the invention.

The image input I/F 220, based on synchronization signals (a vertical synchronization signal and a horizontal synchronization signal) included in the input image signal Vin, processes an image data signal (an analog or digital image data signal) representing an image included in the input image signal Vin, and transmits a digital image data signal Dip to be input into the resolution converter 240.

The timing controller 230 generates timing control signals which control operations of the resolution converter 240, memory controller 260, display data controller 250, keystone processor 280 and liquid crystal panel drive 290, and supplies them to individual blocks. The figure shows, particularly, only a frame start signal Fst and a frame completion signal Fend, particularly necessary to describe the embodiment, which occur in each frame period.

The resolution converter 240, as well as once storing image data (input image data), included in the digital image data signal Dip received from the image input I/F 220, in the frame memory 270 via the memory controller 260, reads the image data stored in the frame memory 270 and, by converting a resolution of an image represented by the input image data into a resolution according to a set projection size, generates resolution converted data. In response to a resolution converted data request relayed by means of a resolution converted data request signal Rready from the display data controller 250, the generated resolution converted data are transmitted as a resolution converted data signal Rdata together with a resolution converted data validity signal Rvalid acting as a resolution converted data validity notification, and input into the display data controller 250. The resolution of the image represented by the resolution converted data is determined by multiplying together a resolution of the liquid crystal panel 120 acting as the fixed pixel display device and a resolution conversion ratio represented by a product of a projection size compatible resolution conversion ratio which, with a projection size, in a case of projecting an image of a resolution equal to the resolution of the liquid crystal panel 120, as a reference (a reference projection size), is indicated by a ratio to the reference projection size, and a fixed image display compatible resolution conversion ratio which is determined based on a ratio of the resolution of the image represented by the input image data to the resolution of the liquid crystal panel 120. The resolution conversion ratio is given in advance to the resolution converter 240 by an unshown controller which controls a whole.

Hereafter, there is also a case in which the resolution of the image represented by the image data included in the image signal is described abbreviated simply as an "image signal resolution" or an "image data resolution".

The display data controller 250, as well as transmitting the resolution converted data request signal Rready, based on the resolution converted data signal Rdata and the resolution converted data validity signal Rvalid which are transmitted from the resolution converter 240 in response thereto, accumulates the resolution converted data, included in the resolution converted data signal Rdata, in an unshown data adjustment image memory on a per horizontal line basis of an image represented by the resolution converted data (a resolution converted image). Also, the display data controller 250, based on a display image data request signal Dready transmitted from the keystone processor 280, reads the accumulated resolution converted data in order, and transmits them as a display image data signal Ddata. Also, the display data controller 250, in accordance with the transmission of the display image data signal Ddata, transmits a display image data validity signal Dvalid indicating a display image data validity notification. Features of the invention lie in that the display data controller 250 controls an operation of receiving the resolution converted data transmitted from the resolution converter 240 as the resolution converted data signal Rdata, and accumulating them in the unshown data adjustment image memory, in order, on the per horizontal line basis, and an operation of reading the resolution converted data accumulated in the data adjustment image memory in order as the display image data, and transmitting them to the keystone processor 280 as the display image data signal Ddata. A further description will hereafter be given of the control operation.

The keystone processor 280 executes a keystone process on the display image data included in the display image data signal Ddata received from the display data controller 250, and generates keystone correction image data. Then, it generates projection image data by means of the generated keystone correction image data, and supplies the generated projection image data to the liquid crystal panel drive 290 as a projection image data signal Kdata. Data for a keystone correction (hereafter referred to as "keystone correction data"), determined based on an image projection angle, which are preset in the keystone processor 280, are given in advance to the keystone processor 280 by the unshown controller which controls the whole.

The liquid crystal panel drive 290 converts the projection image data, included in the projection image data signal Kdata received from the keystone processor 280, into drive image data which can be supplied to the liquid crystal panel 120, and transmits them as a drive image data signal Dvdata together with the drive timing signal Dvts.

The liquid crystal panel 120 which has received the drive image data signal Dvdata and the drive timing signal Dvts from the liquid crystal panel drive 290, as heretofore described, modulates the light emitted from the light source 110 in accordance with the drive image data signal Dvdata, and converts it into image light according to the drive image data signal Dvdata. The image light is projected upscaled onto the screen SC by the projection lens 130.

B. CONFIGURATION AND CONTROL OPERATION OF DISPLAY DATA CONTROLLER

Figure 2:
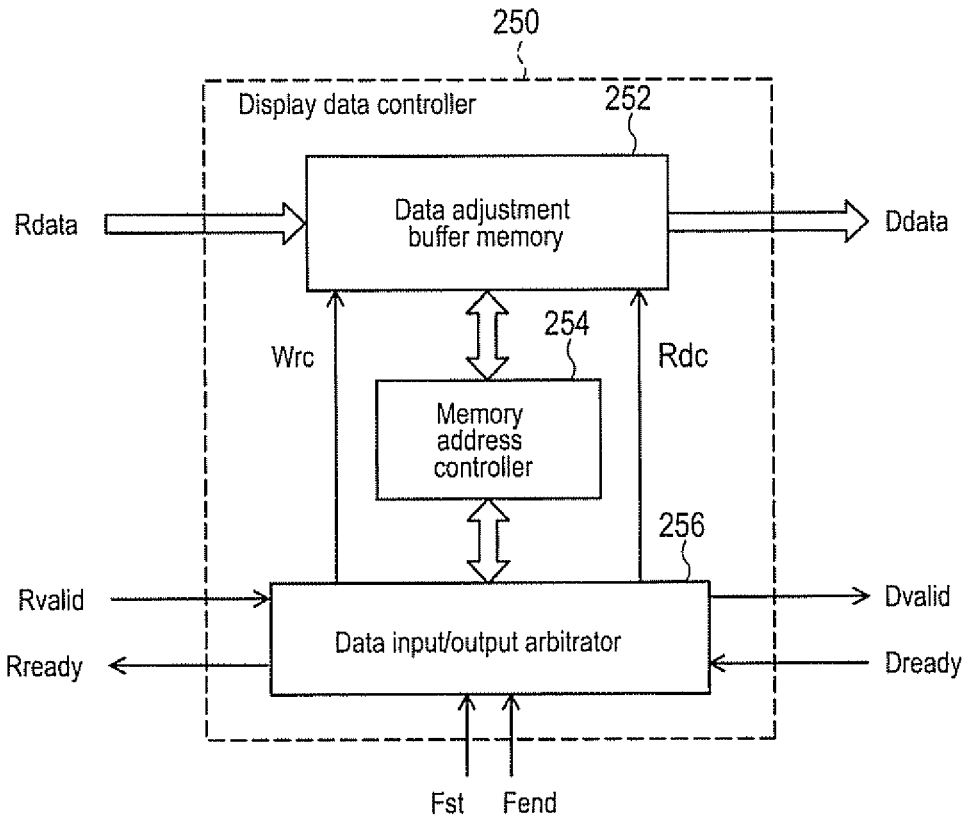
FIG. 2 is a block diagram showing an internal configuration of a display data controller 250.

FIG. 2 is a block diagram showing an internal configuration of the display data controller 250. The display data controller 250 includes a data adjustment buffer memory 252, a memory address controller 254 and a data input/output arbitrator 256.

The data adjustment buffer memory 252 includes a plurality of line memories. The data adjustment buffer memory 252 writes and accumulates the resolution converted data, included in the resolution converted data signal Rdata transmitted by the resolution converter 240, in order in a storage area of a line memory corresponding to a write memory address transmitted by the memory address controller 254, with a write timing represented by a write control signal Wrc transmitted by the data input/output arbitrator 256. Also, the data adjustment buffer memory 252 reads the resolution converted data, stored in the storage area of the line memory corresponding to the write memory address transmitted by the memory address controller 254, in order as the display image data, with a read timing represented by a read control signal Rdc transmitted by the data input/output arbitrator 256, and transmits the read display image data as the display image data signal Ddata.

During a time period from a frame start notification indicated by the frame start signal Fst to a frame completion notification indicated by the frame completion signal Fend, the data input/output arbitrator 256, by asserting the resolution converted data request signal Rready, controls an operation of transmitting the resolution converted data signal Rdata and the resolution converted data validity signal Rvalid by means of the resolution converter 240. Then, based on the resolution converted data validity signal Rvalid, it transmits the write control signal Wrc, and writes the resolution converted data, included in the resolution converted data signal Rdata, into the data adjustment buffer memory 252.

Also, during the time period form the frame start notification to the frame completion notification, the data input/output arbitrator 256, by transmitting the read control signal Rdc based on the display image data request signal Dready transmitted by the keystone processor 280, reads the resolution converted data, stored in the data adjustment buffer memory 252, as the display image data, and transmits the display image data signal Ddata including the read display image data, and the display image data validity signal Dvalid, to the keystone processor 280.

The data input/output arbitrator 256 arbitrates, as will be described hereafter, the control of the operation of receiving the resolution converted data from the resolution converter 240, and a control of an operation of transmitting the display image data to the keystone processor 280, which are executed in the way heretofore described.

Figure 3:
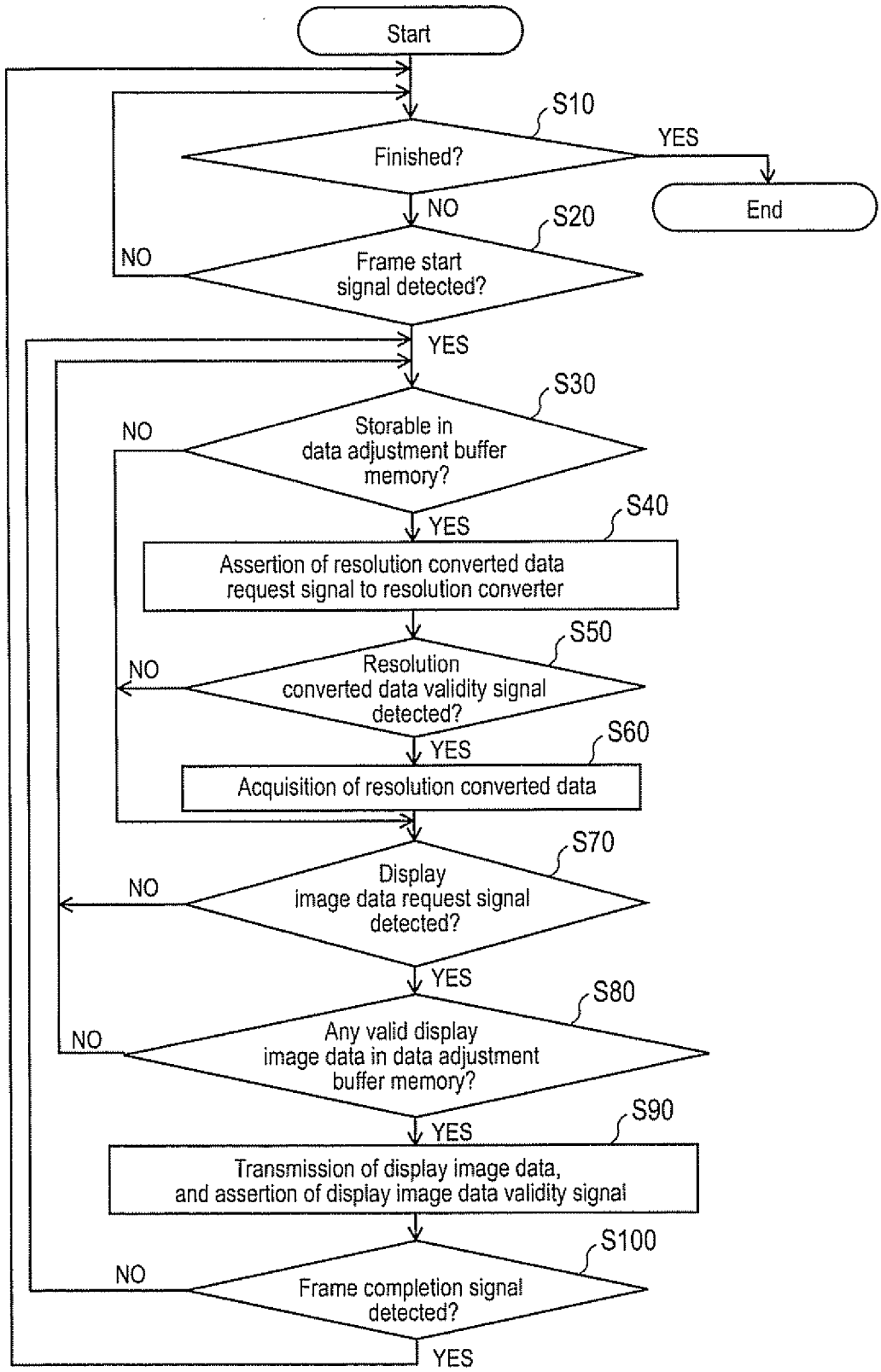
FIG. 3 is an illustration showing a procedure of an arbitration operation by a data input/output arbitrator 256 of the display data controller 250.

FIG. 3 is an illustration showing a procedure of an arbitration operation by the data input/output arbitrator 256 of the display data controller 250. The arbitration operation shown in FIG. 3 is started at a start-up time of the projector, and finished when an operation of the projector is stopped (step S10: Yes). Consequently, the arbitration operation by the data input/output arbitrator 256 is realized by repeatedly executing processes, to be described hereafter, until the operation of the projector is stopped (step S10: No).

In step S20, a process waits until the frame start notification by the frame start signal Fst is detected (step S20: Yes). If the frame start notification is detected (step S20: Yes), a process of step S30 is executed.

In step S30, it is determined whether or not there is a storable line memory, among the plurality of line memories configuring the data adjustment buffer memory 252. If there is a storable line memory (step 30: Yes), a process of step S40 is executed while, if there is no storable line memory (step S30: No), a process of step S70 is executed.

The storable line memory means a line memory in which no data has been stored yet, or a line memory from which the resolution converted data once stored therein have been read and transmitted as the display image data, as will be described hereafter. In order to control an address of a line memory, from among the plurality of line memories of the data adjustment buffer memory 252, on which a writing is executed, via the memory address controller 254, the data input/output arbitrator 256 manages a condition of each line memory of the data adjustment buffer memory 252, for example, an order of writing the image data into each line memory or an order of reading the image data from each line memory, a storable line memory and the like. Consequently, the data input/output arbitrator 256, based on this management information, determines the storable line memory, and controls a memory address, for which the writing or reading of the image data is executed, via the memory address controller 254.

In step S40, the resolution converted data request signal Rready is asserted, and the resolution converted data request is relayed to the resolution converter 240.

Then, in step S50, a detection of the resolution converted data validity signal Rvalid transmitted from the resolution converter 240 is carried out in response to the resolution converted data request in step S40, and it is determined whether or not the resolution converted data validity signal Rvalid is asserted. If the resolution converted data validity signal Rvalid is asserted (step S50: Yes), after an acquisition of the resolution converted data included in the resolution converted data signal Rdata, transmitted from the resolution converter 240 together with the resolution converted data validity signal Rvalid, is executed in step S60, a process of step S70 is executed while, if the resolution converted data validity signal Rvalid is not asserted (step S50: No), the process of step S70 is executed.

In step S70, a detection of the display image data request signal Dready transmitted from the keystone processor 280 is carried out, and it is determined whether or not the display image data request signal Dready is asserted. If the display image data request signal Dready is asserted (step S70: Yes), a determination process of step S80 is executed while, if the display image data request signal Dready is not asserted (step S70: No), the processes of steps S30 to S70 are repeated until the display image data request signal Dready is asserted.

In step S80, it is determined whether or not valid resolution converted data are stored in any one of the plurality of line memories configuring the data adjustment buffer memory 252. If it is determined that valid resolution converted data are stored (step S80: Yes), a determination process of step S90 is executed while, if it is determined that no valid resolution converted data are stored (step S80: No), the processes of steps S30 to S70 are repeated until it is determined that valid resolution converted data are stored.

The valid resolution converted data mean resolution converted data, among the resolution converted data written in any one line memory, which have not yet been read or transmitted to the keystone processor 280 as the display image data. As heretofore described, the data input/output arbitrator 256 manages the condition of each line memory of the data adjustment buffer memory 252 and, based on this management information, can determine an existence or otherwise of a line memory in which are stored the valid resolution converted data.

In step S90, as well as the display image data validity signal Dvalid being asserted, the valid resolution converted data are read as the display image data from the line memory in which are stored the valid resolution converted data, and the read display image data are transmitted as the display image data signal Ddata.

Then, in step S100, a detection of the frame completion signal Fend is carried out, and it is determined whether or not there is a frame completion notification. If there is no frame completion notification (step S100: No), the processes of steps S30 to S100 are repeated while, if there is a frame completion notification (step S100: Yes), the process returns to the top, and the processes of steps S10 to S100 are repeated until the operation of the projector is stopped (step S10: No).

By the data input/output arbitrator 256 of the display data controller 250 executing the heretofore described process operation, it is possible to execute, while arbitrating, an operation of acquiring the resolution converted data from the display data controller 250 and holding them, and an operation of transmitting the acquired resolution converted data to the keystone processor 280 as the display image data.

Figure 4:
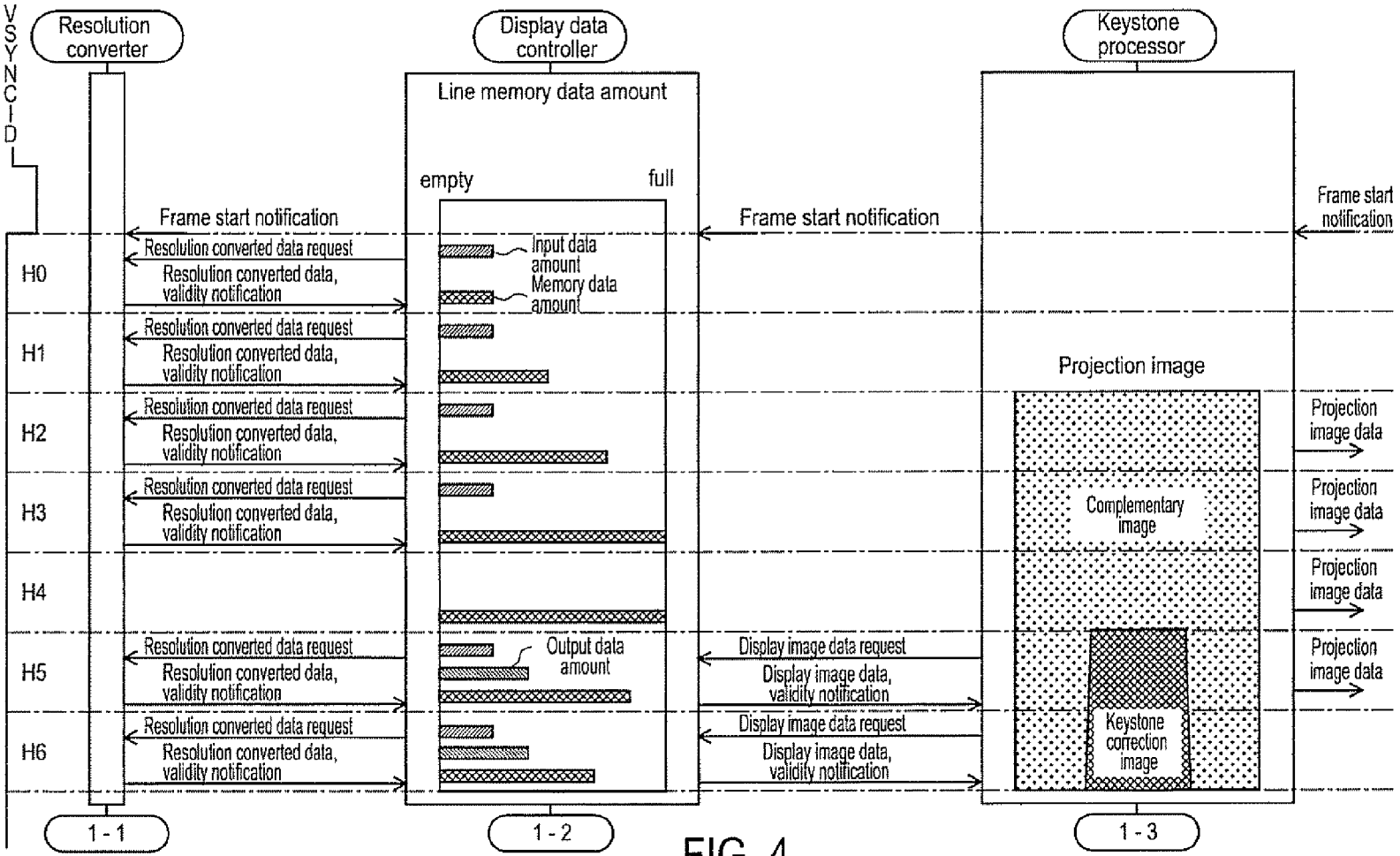
FIGS. 4 to 6 are illustrations showing a specific example of an operation of acquiring resolution converted data from a resolution converter 240 and holding them, and an operation of transmitting display image data to a keystone processor 280, by means of the display data controller 250.
Figure 5:
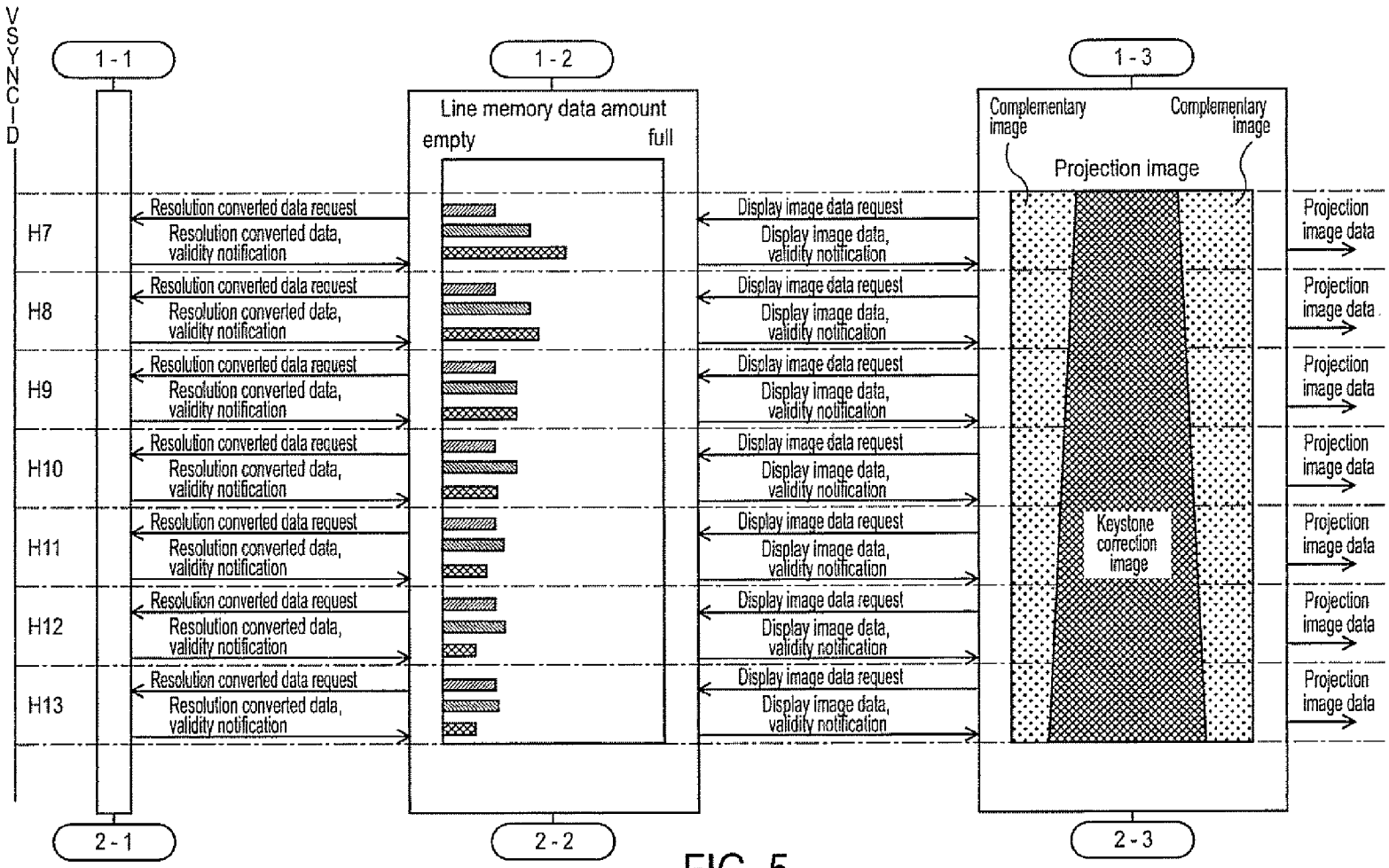
Figure 6:
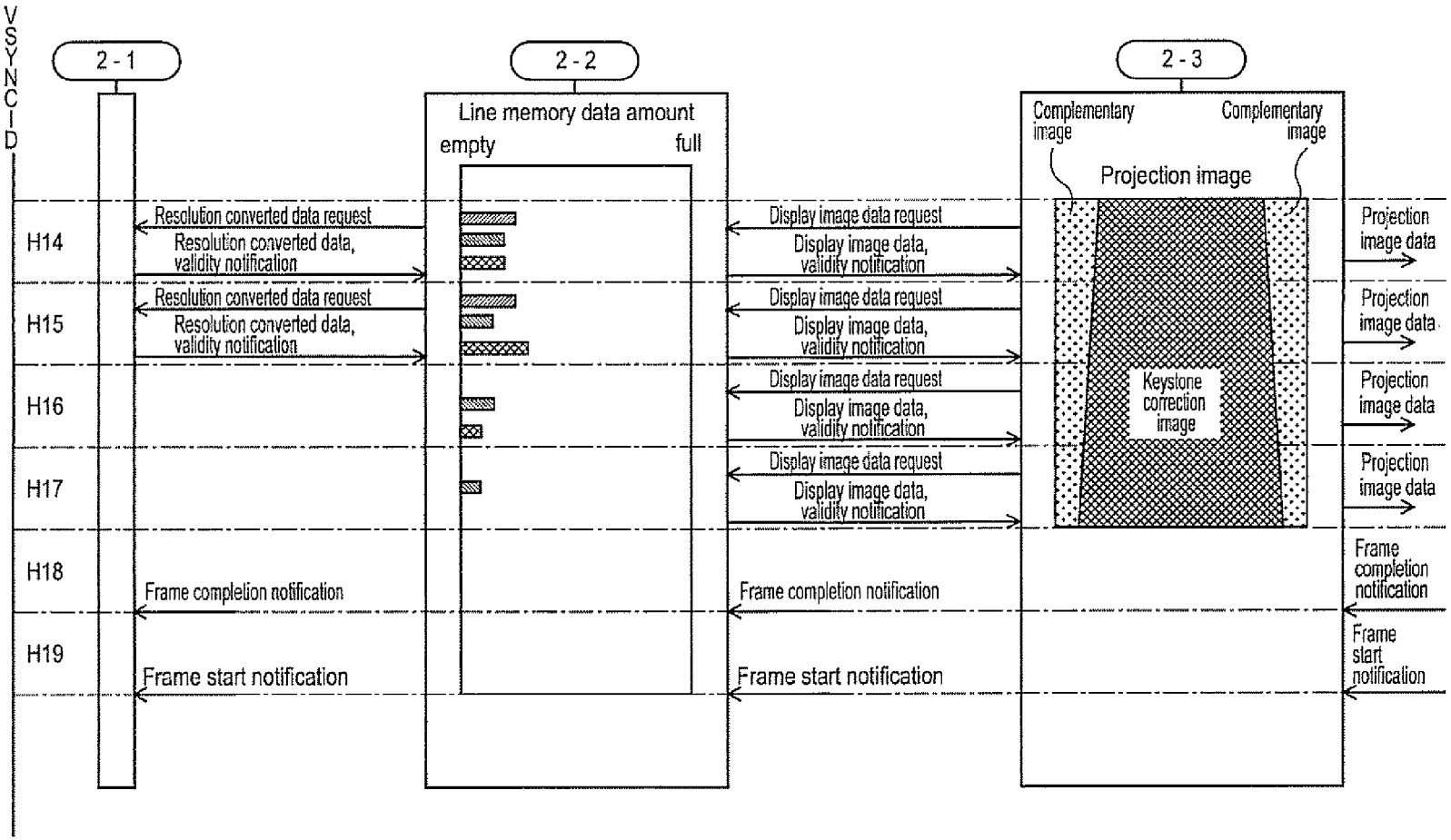
Figure 7:
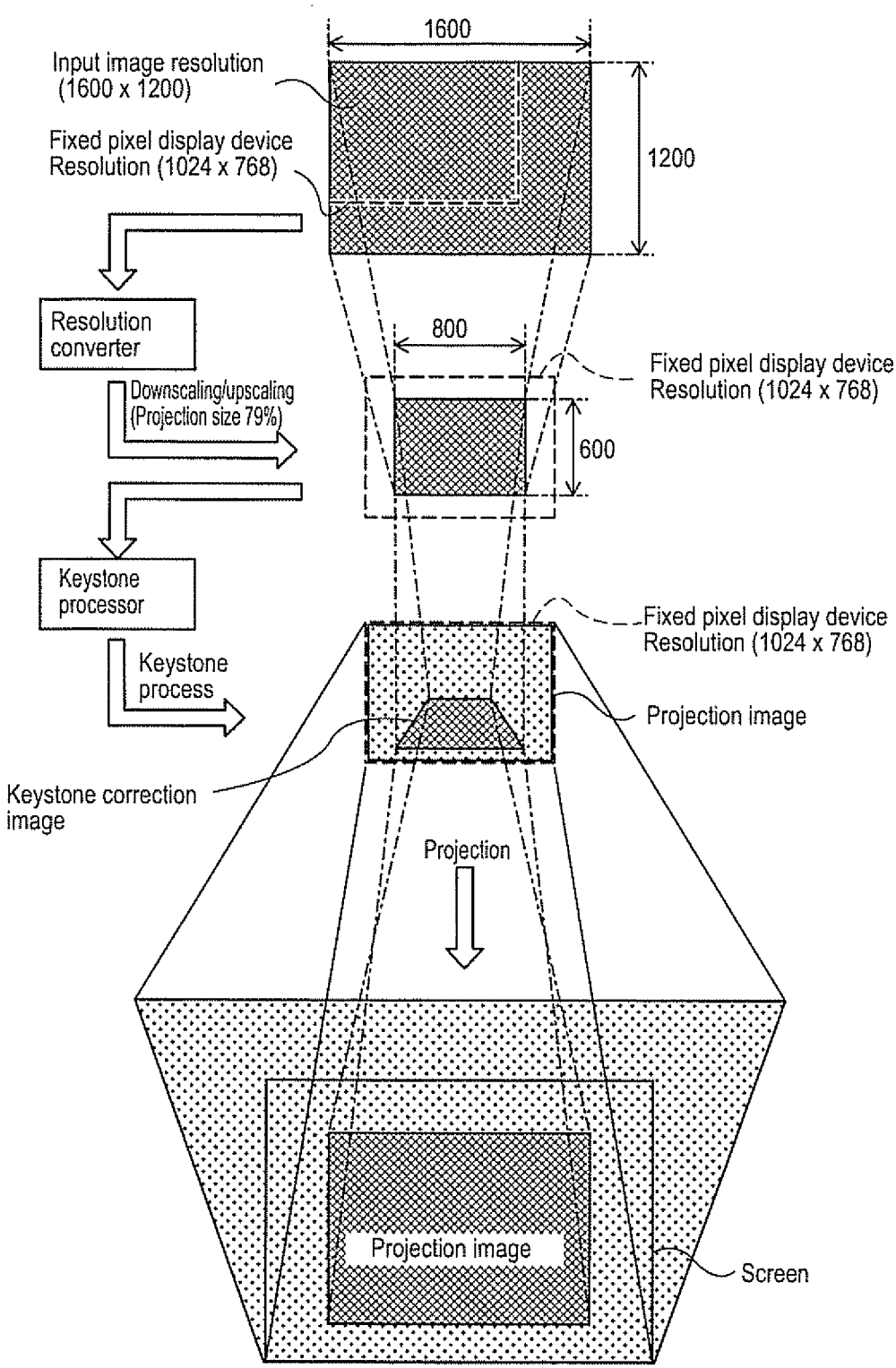
FIG. 7 is an illustration showing an outline of a process executed in a case in which an image is projected by a heretofore known projector.

FIGS. 4 to 6 are illustrations showing a specific example of the operation of acquiring the resolution converted data from the resolution converter 240 and holding them, and the operation of transmitting the display image data to the keystone processor 280, by means of the display data controller 250. A vertical synchronization signal VSYNC-D shown at the left end of each of the figures indicates a vertical period (a frame period) which serves as a reference of a timing for forming the projection image on the liquid crystal panel 120. In the following description, a description will be given, taking it that horizontal periods, which serve as references of timings for forming horizontal lines of the projection image on the liquid crystal panel 120, are used to express the frame period, indicated by the vertical synchronization signal VSYNC-D, as a length equivalent to 20 lines from a first horizontal period H0 to a twentieth horizontal period H19. Also, a description will be given, taking it that, during a time period from the third horizontal period H2 to the eighteenth horizontal period H17, projection image data corresponding to each horizontal line are supplied to the liquid crystal panel 120 from the keystone processor 280 and, particularly, during a time period from the sixth horizontal period H5 to the eighteenth horizontal period H17, the projection image data are configured by the keystone correction image data acquired by executing the keystone process on the display image data supplied from the display data controller 250.

Diagrams shown in the block of the display data controller 250 in the figures are bar graphs showing a relationship between an amount of resolution converted data received from the resolution converter 240 (diagonally right up-hatched bar graphs), an amount of resolution converted data on the per horizontal line basis, stored in the data adjustment buffer memory 252 (crosshatched bar graphs), and an amount of resolution converted data transmitted to the keystone processor 280 as the display image data.

Diagrams shown in the process block of the keystone processor 280 show the projection image represented by the projection image data transmitted from the keystone processor 280. A trapezoidal graphic portion (shown crosshatched) of the projection image shown in the figures is a portion of the keystone correction image represented by the keystone correction image data acquired by actually executing the keystone process on the display image data supplied from the display data controller 250 in order to correct the projection distortion, and a surrounding graphic portion (shown dotted) is a portion in which by rights nothing is displayed but, as it is necessary to always give data to each pixel of the liquid crystal panel 120, shows a complementary image portion represented by complementary image data generated in response to this necessity. As the complementary image portion is a portion which by rights should be nondisplayed, in order to respond to this, it is common to use therein image data corresponding to a black image equivalent to the nondisplay (hereafter referred to as "black image data"). However, not being limited to this, it is also acceptable to use image data of various fixed luminance levels. In the example of the figures, during a time period from the first horizontal period H0 to the fifth horizontal period H4, the actual keystone process is not executed, and only the complementary image data are transmitted as the projection image data while, from the sixth horizontal period H5 onwards, the complementary image data and the keystone correction image data are transmitted as the projection image data.

When a signal level of the vertical synchronization signal VSYNC-D drops to a lower level, the frame start notification is input into the resolution converter 240, display data controller 250 and keystone processor 280.

The display data controller 250, on receiving the frame start notification, repeatedly executes an issue of the resolution converted data request to the resolution converter 240, and a reception of the resolution converted data and resolution converted data validity notification, which are supplied from the resolution converter 240 in response to the resolution converted data request, until receiving resolution converted data equivalent to a number of horizontal lines corresponding to the resolution of the resolution converted data transmitted from the resolution converter 240. In the actual process, a process of the issue of the resolution converted data request to the resolution converter 240, and of the reception of the resolution converted data and resolution converted data validity notification responding to this request, is executed at a higher speed than a process of the image formation in the liquid crystal panel 120 but, in order to facilitate the description, the processes are illustrated as being executed at the same speed.

Herein, the keystone processor 280, as it does not execute the actual keystone process operation as far as the fifth horizontal period H4, as heretofore described, does not make an issue of the display image data request to the display data controller 250. For this reason, the resolution converted data supplied from the resolution converter 240 are accumulated in the data adjustment buffer memory 252 of the display data controller 250, in order, on the per horizontal line basis. In the embodiment, the number of line memories of the data adjustment buffer memory 252 is described as four. However, the number of line memories, not being limited to this, is determined in accordance with a relationship between a speed of a process of acquiring the resolution converted data from the resolution converter 240 and a speed of a process of transmitting the display image data to the keystone processor 280, a required projection angle range, a resolution conversion range, or the like.

When the resolution converted image data equivalent to four lines are input into the display data controller 250 from the resolution converter 240, as the data adjustment buffer memory 252 has no more storable line memory and attains a full condition (full), it cannot accumulate any more. For this reason, in the fifth horizontal period H4, as shown in FIG. 4, the display data controller 250 does not issue the resolution converted data request to the resolution converter 240, and stops the reception of the resolution converted data from the resolution converter 240.

The keystone processor 280, during the time period from the sixth horizontal period H5 to the eighteenth horizontal period H17, repeatedly executes the issue of the display image data request to the display data controller 250, and a reception of the display image data and display image data validity notification, supplied from the display data controller 250 in response to the display image data request, until receiving resolution converted data, equivalent to a number of horizontal lines corresponding to the resolution of the resolution converted data stored and held in the display data controller 250, as the display image data. Also, the keystone processor 280 executes the keystone process on the received display image data, generates the keystone correction image data, and transmits them as the projection image data. In the actual process, a process of the issue of the display image data request to the display data controller 250, and of the reception of the display image data and display image data validity notification responding to this request, is executed at a higher speed than the process of the image formation in the liquid crystal panel 120 but, in order to facilitate the description, the processes are illustrated as being executed at the same speed.

As can be seen from the above description, a "predetermined timing prior to a correction process start time" in some aspects of the invention corresponds to the time at which the frame start notification is issued. A "time period from a correction process start time to finish time" corresponds to a time period from the keystone processor 280 issuing a first display image data request until receiving the display image data in accordance with an issue of a last display image data request, or a time period until the keystone process executed using the received display image data finishes. A "first instruction" corresponds to the resolution converted data request, and a "second instruction" corresponds to the display image data request.

As heretofore described, in the display data controller 250, it is possible to receive and accumulate the resolution converted data in advance during a time period until the keystone process is actually started in the keystone processor 280. It is possible to supply the display image data to the keystone processor 280 while arbitrating the reception of the resolution converted data from the resolution converter 240, and the transmission of the display image data to the keystone processor 280, by means of the data input/output arbitrator 256. By this means, in the keystone processor 280, when actually executing the keystone process, it not being necessary to consider a wait time for a resolution conversion process executed in the resolution converter 240, it is possible to generate the keystone correction image data by receiving the resolution converted data, stored and held in the display data controller 250, in order for each horizontal line as the display image data, and subjecting them to the keystone process. As a result of this, in the keystone processor, it being possible to allot the wait time for the resolution conversion process in the resolution converter to a process time for the keystone process, it is possible to ease a restriction on the projection angle range, and realize an expansion of the projection angle range.

Also, the plurality of line memories configuring the data adjustment buffer memory 252 included in the display data controller 250 of the embodiment being able to be realized with a very small storage capacity in comparison with a frame memory for storing resolution converted data for one frame, it is advantageous with regard to a manufacturing cost. For example, in a case in which a size of the resolution converted data for one frame is XSA (1024'768 dots), they can be realized by about 4 to 32 line memories.

C. MODIFICATION EXAMPLES

Of the components in the heretofore described embodiment, components other than those claimed in the independent claims, being additional ones, can be omitted as appropriate. Also, the invention, not being limited to the heretofore described example or embodiment, can be carried out in various modes without departing from its scope and, for example, the following kinds of modification are possible.

C1. Modification Example 1

The heretofore described embodiment has been described, exemplifying the liquid crystal projector 1000 using the liquid crystal panel 120 but, not being limited to this, can be applied to a projector using any kind of fixed pixel display device.

C2. Modification Example 2

The heretofore described embodiment has been described, exemplifying a case of disposing the display data controller 250 between the resolution converter 240 and the keystone processor 280, but it is also acceptable to have, for example, a configuration of arbitrating an operation of acquiring the projection image data from the keystone processor 280, and an operation of transmitting them to the liquid crystal panel drive 290, between the keystone processor 280 and the liquid crystal panel drive 290. With this kind of configuration too, it is possible to expand the projection angle range.

What is claimed is:

1. A projector which displays an image by projecting a projection image onto a projection surface, comprising:

a fixed pixel display device that displays the projection image in a predetermined vertical period corresponding to one image frame period; and an image processing device that generates the projection image in the vertical period, and includes:

(i) a resolution converter which, by converting a resolution of an input image in the vertical period, generates and transmits a display image having a desired resolution;

(ii) a projection distortion corrector which receives the display image, and generates the projection image by executing a correction process that includes correcting the display image in the vertical period in such a way as to correct a projection distortion occurring due to a projection angle with respect to the projection surface when projecting the projection image; and (iii) a display image input/output controller which receives the display image from the resolution converter and outputs the display image to the projection distortion corrector, the display image input/output controller being provided between the resolution converter and the projection distortion corrector, the display image input/output controller including a data input/output arbitrator that outputs a first instruction to control reception of the display image and outputs a second instruction to control transmission of the display image, and a data adjustment buffer memory that writes the display image in a storage area of a line memory corresponding to a write memory address transmitted by a memory address controller, the first instruction from the data input/output arbitrator directing the data adjustment buffer memory to write the display image in the line memory, and the second instruction from the data input/output arbitrator directing the data adjustment buffer memory to transmit the display image to the projection distortion corrector; and in the vertical period, the display image input/output controller holding the display image while receiving it from the resolution converter, during a time period from a predetermined timing prior to a start time of the correction process to a finish time of the correction process, and transmitting the display image to the projection distortion corrector, during a time period from the start time to the finish time of the correction process.

2. The projector according to claim 1, the display image input/output controller, including:

an image memory having a plurality of line memories capable of accumulating images equivalent to one horizontal line of the display image, in the event that there is an updatable line memory, among the plurality of line memories, by giving the resolution converter a first instruction to transmit the display image, receives the display image transmitted from the resolution converter, and accumulates it in the image memory and, in the event that there is no updatable line memory, among the plurality of line memories, by not giving the first instruction, as well as stopping the transmission of the display image from the resolution converter and stopping the accumulation of the display image in the image memory, by receiving a second instruction to transmit the display image accumulated in the image memory, reads and transmits the display image accumulated in the image memory.

3. The projector according to claim 2, a number of the plurality of line memories included in the image memory being determined to be smaller than that of the fixed pixel display device in accordance with a difference between a processing speed of the resolution conversion in the resolution converter and a processing speed of the projection distortion correction in the projection distortion corrector.

4. An image processing device, included in a projector which displays an image by projecting a projection image displayed by a fixed pixel display device onto a projection surface, for generating the projection image in a predetermined vertical period corresponding to one image frame period, comprising:

a resolution converter which, by converting a resolution of an input image in the vertical period, generates and transmits a display image having a desired resolution;

a projection distortion corrector which receives the display image, and generates the projection image by executing a correction process that includes correcting the display image in the vertical period in such a way as to correct a projection distortion occurring due to a projection angle with respect to the projection surface when projecting the projection image; and a display image input/output controller which receives the display image from the resolution converter and outputs the display image to the projection distortion corrector, the display image input/output controller being provided between the resolution converter and the projection distortion corrector, the display image input/output controller including a data input/output arbitrator that outputs a first instruction to control reception of the display image and outputs a second instruction to control transmission of the display image, and a data adjustment buffer memory that writes the display image in a storage area of a line memory corresponding to a write memory address transmitted by a memory address controller, the first instruction from the data input/output arbitrator directing the data adjustment buffer memory to write the display image in the line memory, and the second instruction from the data input/output arbitrator directing the data adjustment buffer memory to transmit the display image to the projection distortion corrector; and in the vertical period, the display image input/output controller holding the display image while receiving it from the resolution converter, during a time period from a predetermined timing prior to a start time of the correction process to a finish time of the correction process, and transmitting the display image to the projection distortion corrector, during a time period from the start time to the finish time of the correction process.

5. The image processing device according to claim 4, the display image input/output controller, including:

an image memory having a plurality of line memories capable of accumulating images equivalent to one horizontal line of the display image, in the event that there is an updatable line memory, among the plurality of line memories, by giving the resolution converter a first instruction to transmit the display image, receives the display image transmitted from the resolution converter, and accumulates it in the image memory and, in the event that there is no updatable line memory, among the plurality of line memories, by not giving the first instruction, as well as stopping the transmission of the display image from the resolution converter and stopping the accumulation of the display image in the image memory, by receiving a second instruction to transmit the display image accumulated in the image memory, reads and transmits the display image accumulated in the image memory.

6. The image processing device according to claim 5, a number of the plurality of line memories included in the image memory being determined to be smaller than that of the fixed pixel display device in accordance with a difference between a processing speed of the resolution conversion in the resolution converter and a processing speed of the projection distortion correction in the projection distortion corrector.

7. A system comprising:

(i) a projection surface; and (ii) a projector;

the projector displaying a projection image onto the projection surface;

the projector including:

(a) a fixed pixel display device that displays the projection image in a predetermined vertical period corresponding to one image frame period; and (b) an image processing device that generates the projection image in the vertical period;

the image processing device further including:

(a) an image resolution conversion unit;

(b) a projection distortion correction unit; and (c) a display image controller unit;

the image resolution conversion unit including:

(a) means for converting a resolution of an input image in at least a fraction of the vertical period;

(b) means for generating a display image having a desired resolution; and (c) means for transmitting the display image;

the projection distortion correction unit including:

(a) means for receiving the display image;

(b) means for generating the projection image by correcting the display image, during at least a fraction of the vertical period, to account for distortions of the projection image that occur based on an angle in relation to the projection surface by which the projection image is projected;

the display image controller unit including:

(a) means for controlling reception of the display image from the image resolution conversion unit;

(b) means for controlling transmission of the display image to the projection distortion correction unit;

(c) means for receiving the display image from the image resolution conversion unit during a time period between a predetermined time prior to a start time of the correcting of the display image and a finish time of the correcting of the display image;

(d) means for storing the display image while receiving it from the means for resolution conversion unit during a time period that is at least a fraction of the time between a predetermined time prior to the start time of the correcting of the display image and the finish time of the correcting of the display image;

(e) means for reading the display image from storage for transmission, during a time period that is at least a fraction of the time between the start time and the finish time;

(f) means for transmitting the display image to the projection distortion correction unit during a time period between the start time of the correcting of the display image and the finish time of the correcting of the display image, the display image controller unit being provided between the image resolution conversion unit and the projection distortion correction unit;

(g) means for outputting a first instruction to control reception of the display image and a second instruction to control transmission of the display image; and (h) means for writing the display image in a storage area of a line memory corresponding to a write memory address transmitted by a memory address controller, the first instruction directing the writing of the display image in the line memory, and the second instruction directing the transmitting of the display image to the projection distortion correction unit.

8. The system according to claim 7, the display image having a resolution equal to or less than a resolution of the fixed pixel display device.

9. The system according to claim 7, the display image controller unit, including:

(a) an image memory unit having a plurality of memory elements, the plurality of memory elements collectively being capable of accumulating images equivalent to one horizontal line of the display image, in the event that there is at least one updatable memory element, among the plurality of memory elements, by giving the image resolution conversion unit a first instruction to transmit the display image, the display image controller unit receives the display image transmitted from the image resolution conversion unit, and accumulates it in the image memory unit; and in the event that there is no updatable memory element, among the plurality memory elements, by not giving the first instruction, as well as stopping the transmission of the display image from the image resolution conversion unit and stopping the accumulation of the display image in the image memory unit, by receiving a second instruction to transmit the display image accumulated in the image memory unit, the display image controller unit reads and transmits the display image accumulated in the image memory unit.

10. The system according to claim 9, a number of the plurality of memory elements included in the image memory unit being determined to be smaller than that of the fixed pixel display device in accordance with a difference between a processing speed of the resolution conversion in the resolution converter and a processing speed of the projection distortion correction in the projection distortion correction unit.

11. The projector according to claim 1, the data input/output arbitrator transmitting, before the predetermined timing prior to the start time of the process of correcting the display image, a data request signal to the resolution converter, and upon receipt of a data validity signal from the resolution converter, the data input/output arbitrator transmitting the first instruction to the data adjustment buffer memory.

12. The projector according to claim 1, wherein the display image input/output controller further arbitrates an operation of acquiring the image data from the projection distortion corrector and an operation of transmitting the image data to a liquid crystal panel drive, between the projection distortion corrector and the liquid crystal panel drive.

13. The image processing device according to claim 4, wherein the display image input/output controller further arbitrates an operation of acquiring the image data from the projection distortion corrector and an operation of transmitting the image data to a liquid crystal panel drive, between the projection distortion corrector and the liquid crystal panel drive.

14. The projector of claim 1, wherein the first instruction from the data input/output arbitrator directing the data adjustment buffer memory to write the display image in the line memory is written in an order, and the second instruction from the data input/output arbitrator directing the data adjustment buffer memory to transmit the display image to the projection distortion corrector is written in the same order that the data adjustment buffer wrote the display image in the line memory.

* * * * *